US008056374B2

(12) United States Patent
Hoppe

(10) Patent No.: US 8,056,374 B2
(45) Date of Patent: Nov. 15, 2011

(54) MULTIPLE COMPARTMENTS WASH ADDITIVES AUTO-DISPENSER IN WASHER OR DRYER PEDESTAL

(75) Inventor: Christopher Gregory Hoppe, Louisville, KY (US)

(73) Assignee: General Electric Company, Schenectady, NY (US)

( * ) Notice: Subject to any disclaimer, the term of this patent is extended or adjusted under 35 U.S.C. 154(b) by 438 days.

(21) Appl. No.: 11/871,726

(22) Filed: Oct. 12, 2007

(65) Prior Publication Data

US 2009/0095331 A1 Apr. 16, 2009

(51) Int. Cl.
*D06F 29/00* (2006.01)
*D06F 35/00* (2006.01)
*B08B 3/00* (2006.01)

(52) U.S. Cl. ..... 68/12.18; 68/17 R; 134/99.2

(58) Field of Classification Search ..... 68/12.18, 68/17 R; 134/99.2
See application file for complete search history.

(56) References Cited

U.S. PATENT DOCUMENTS

| | | | | |
|---|---|---|---|---|
| 2,699,886 | A | 1/1955 | James | |
| 2,946,489 | A | 7/1960 | Brucken | |
| 3,013,568 | A | 12/1961 | Getchell et al. | |
| 3,045,876 | A | 7/1962 | Marchi | 222/386 |
| 3,107,824 | A | 10/1963 | Perl | |
| 3,124,271 | A | 3/1964 | Beck | 222/644 |
| 3,289,896 | A | 12/1966 | Cushing | |
| 3,402,853 | A | 9/1968 | Pert | |
| 3,595,036 | A | 7/1971 | DePas | |
| 3,608,514 | A | 9/1971 | Dunn | |
| 3,826,113 | A | 7/1974 | Boraas et al. | |
| 3,827,600 | A | 8/1974 | Janke | |
| 3,856,058 | A | 12/1974 | Fackler | |
| 3,896,827 | A | 7/1975 | Robinson | |
| 4,009,598 | A | 3/1977 | Bernard et al. | |
| 4,063,663 | A | 12/1977 | Larson et al. | |
| 4,149,654 | A | 4/1979 | Nelson et al. | |
| 4,149,657 | A | 4/1979 | Nelson et al. | |
| RE30,097 | E | 9/1979 | Gillespie | 68/12.08 |
| 4,213,338 | A | 7/1980 | Hardy | |

(Continued)

FOREIGN PATENT DOCUMENTS

DE 24 07 544 8/1975

(Continued)

OTHER PUBLICATIONS

Official Office Action mailed Jan. 12, 2010, in U.S. Appl. No. 11/871,750, pp. 1-10.

(Continued)

*Primary Examiner* — Michael Barr
*Assistant Examiner* — Charles W Kling
(74) *Attorney, Agent, or Firm* — Merchant & Gould

(57) ABSTRACT

Systems and methods for delivering a first additive to an appliance are disclosed. The systems include a first storage container located in a pedestal, a first pump operatively connected to the first storage container and the appliance. A controller is configured to activate the first pump upon receiving an input. The first pump configured to deliver the first additive from the first storage container to the appliance. The methods include receiving a first input. The first input specifying an amount of the first additive to be delivered to the appliance. The first additive is delivered by activating a first pump in response to receiving the first input. Activating the first pump causes the first additive to be delivered to the appliance.

2 Claims, 2 Drawing Sheets

U.S. PATENT DOCUMENTS

| | | | | |
|---|---|---|---|---|
| 4,334,881 | A | 6/1982 | Reinert et al. | |
| 4,373,863 | A | 2/1983 | Mason et al. | |
| 4,488,666 | A | 12/1984 | Herbst et al. | |
| 4,756,321 | A | 7/1988 | Livingston et al. | |
| 4,830,509 | A | 5/1989 | Gulmatico, Jr. | |
| 4,845,965 | A | 7/1989 | Copeland et al. | |
| 4,932,227 | A | 6/1990 | Hogrefe | |
| 5,033,659 | A | 7/1991 | Marks et al. | |
| 5,133,487 | A | 7/1992 | Russi | |
| 5,144,819 | A | 9/1992 | Hiyama et al. | 68/12.04 |
| 5,211,188 | A | 5/1993 | Kraus | |
| 5,241,845 | A | 9/1993 | Ishibashi et al. | 68/12.02 |
| 5,390,385 | A | 2/1995 | Beldham | |
| 5,392,618 | A | 2/1995 | Livingston et al. | |
| 5,435,157 | A | 7/1995 | Laughlin | |
| 5,560,060 | A | 10/1996 | Dausch et al. | |
| 5,603,233 | A | 2/1997 | Erickson et al. | |
| 5,647,391 | A | 7/1997 | Chan et al. | |
| 5,743,442 | A | 4/1998 | Barbe | |
| 5,758,521 | A | 6/1998 | Roberts | |
| 5,782,109 | A * | 7/1998 | Spriggs et al. | 68/17 R |
| 5,823,390 | A | 10/1998 | Muderlak et al. | |
| 5,884,808 | A | 3/1999 | Muderlak et al. | |
| 6,012,613 | A | 1/2000 | Chen | |
| 6,095,370 | A | 8/2000 | Rhine et al. | |
| 6,152,327 | A | 11/2000 | Rhine et al. | |
| 6,293,428 | B1 | 9/2001 | Chen | |
| 6,338,351 | B1 | 1/2002 | Schrott | |
| 6,401,499 | B1 | 6/2002 | Clark et al. | |
| 6,434,977 | B1 | 8/2002 | Hapke et al. | 68/17 R |
| 6,453,917 | B1 | 9/2002 | Biechele | |
| 6,463,611 | B1 | 10/2002 | Mattla et al. | |
| 6,616,401 | B2 | 9/2003 | Nakamura et al. | |
| 6,669,052 | B2 * | 12/2003 | Barbe | 222/55 |
| 6,733,252 | B2 | 5/2004 | Feygin et al. | |
| 6,792,637 | B2 | 9/2004 | Reichold et al. | 8/159 |
| 7,658,088 | B2 | 2/2010 | Walker et al. | |
| 7,802,335 | B2 | 9/2010 | Hoppe et al. | |
| 2002/0088502 | A1 | 7/2002 | Van Rompuy et al. | |
| 2002/0117187 | A1 | 8/2002 | Helminger | |
| 2002/0153029 | A1 | 10/2002 | Cerruti et al. | |
| 2003/0127110 | A1 | 7/2003 | Reichold et al. | |
| 2003/0137264 | A1 | 7/2003 | Peterson et al. | |
| 2004/0020517 | A1 | 2/2004 | Cerruti et al. | |
| 2004/0093913 | A1 | 5/2004 | Bolduan et al. | 68/17 R |
| 2004/0226961 | A1 | 11/2004 | Mehus et al. | |
| 2004/0245284 | A1 | 12/2004 | Mehus et al. | |
| 2005/0241347 | A1 | 11/2005 | Cho et al. | |
| 2006/0117811 | A1 | 6/2006 | Kinnetz | |
| 2008/0104768 | A1 | 5/2008 | Choi | 8/147 |
| 2008/0276965 | A1 | 11/2008 | Aykroyd et al. | 134/18 |
| 2009/0095028 | A1 | 4/2009 | Hoppe et al. | |
| 2009/0095750 | A1 | 4/2009 | Vitan et al. | |

FOREIGN PATENT DOCUMENTS

| | | | |
|---|---|---|---|
| DE | 34 42 194 | | 5/1986 |
| DE | 40 00 378 | | 7/1991 |
| DE | 20302572 | * | 4/2003 |
| EP | 0 633 342 | | 1/1995 |
| EP | 0 860 141 | A2 | 8/1998 |
| EP | 0 726 978 | B1 | 9/1998 |
| GB | 2214524 | | 6/1989 |
| GB | 2214524 | * | 9/1989 |
| JP | 60-034493 | | 2/1985 |
| JP | 62-284696 | | 12/1987 |
| JP | 01-178294 | | 7/1989 |
| JP | 02-104393 | | 4/1990 |
| JP | 04-187183 | | 7/1992 |
| JP | 06-233894 | | 8/1994 |
| JP | 07-108095 | | 4/1995 |
| JP | 2001157795 | | 12/2000 |
| JP | 2003-326076 | | 11/2003 |
| KR | 2005-066520 | | 6/2005 |

OTHER PUBLICATIONS

European Patent Office 0 430 366 6-1991.

Official Office Action mailed Sep. 28, 2009, in U.S. Appl. No. 11/871,783, pp. 1-15.

U.S. Official Action mailed May 26, 2010 in U.S. Appl. No. 11/871,783, pp. 1-11.

U.S. Advisory Action mailed Aug. 3, 2010 in U.S. Appl. No. 11/871,783, pp. 1-3.

U.S. Official Action mailed Sep. 28, 2010 in U.S. Appl. No. 11/871,783, pp. 1-9.

U.S. Official Action dated Mar. 14, 2011 in U.S. Appl. No. 11/871,783, pp. 1-9.

* cited by examiner

MULTIPLE COMPARTMENTS WASH ADDITIVES AUTO-DISPENSER IN WASHER OR DRYER PEDESTAL

CROSS-REFERENCE TO RELATED APPLICATIONS

The present application is related to United States patent application having Ser. No. 11/871,750 titled "Bulk Dispense User Adjustable Controls" filed Oct. 12, 2007, and issued as U.S. Pat. No. 7,802,335 on Sep. 28, 2010 and United States patent application having Ser. No. 11/871,783 titled "Removable Tank for Laundry Bulk Dispenser System" filed Oct. 12, 2007, which are hereby incorporated by reference in their entirety.

FIELD OF INVENTION

Embodiments of the present invention generally relate to transportation of additives to an appliance. More specifically, embodiments of the present invention relate to systems and methods for delivering additives from a pedestal located beneath an appliance to the appliance (e.g. a washing machine and/or dryer).

BACKGROUND OF THE INVENTION

Current system for adding additives (e.g. soap, fabric softener, etc.) to an appliance (e.g. washing machine, dryer, etc.) utilize pumps to force air into a container housing the additive thereby increasing the pressure within the container. This increase in pressure forces the additive into the appliance. This increase in pressure can also cause rupturing of the container. In addition, the pumping of air into the container increases the risk of adding contaminates to the additive. Currently, the container is located inside an appliance cabinet and is not accessible to a user without disassembling the appliance. For example, if the container develops a leak, a homeowner or service person would be required to disassemble a washing machine to replace or repair the container.

Having the containers and other hardware (e.g. pumps, circuitry, and other connections) located inside the appliance cabinet also hinders routine maintenance such as cleaning the containers, lubricating the pumps. In addition having the containers located inside the appliance cabinet does not allow a user to alter the additive capacity. For example, the homeowner may want to load two gallons of soap and a half a gallon of fabric softener. If the appliance only has two one-gallon containers, then the homeowner's wishes cannot be accommodated. In addition, current delivery of the additives to the wash bath of the appliance utilizes manual feed of the additives into the respective containers.

Having the above problems in mind, there exist a need for systems and methods for delivering additives to appliances that don't require increasing the pressure within the containers, allow for easy access to the containers and other system components, are customizable based on user preferences, and facilitate easy maintenance.

BRIEF DESCRIPTION OF THE INVENTION

Consistent with embodiments of the present invention, systems for delivering a first additive to an appliance are disclosed. The systems include a first storage container located in a pedestal, a first pump operatively connected to the first storage container and the appliance. A controller is configured to activate the first pump upon receiving an input. The first pump is configured to deliver the first additive from the first storage container to the appliance.

Still consistent with embodiments of the present invention, methods for delivering a first additive to an appliance are disclosed. The appliance being located on a pedestal beneath the appliance. The methods include receiving a first input. The first input specifying an amount of the first additive to be delivered to the appliance. The first additive is delivered by activating a first pump in response to receiving the first input. Activating the first pump causes the first additive to be delivered to the appliance.

BRIEF DESCRIPTION OF THE FIGURES

Non-limiting and non-exhaustive embodiments are described with reference to the following figures, wherein like reference numerals refer to like parts throughout the various views unless otherwise specified.

GENERAL DESCRIPTION

Reference may be made throughout this specification to "one embodiment," "an embodiment," "embodiments," "an aspect," or "aspects" meaning that a particular described feature, structure, or characteristic may be included in at least one embodiment of the present invention. Thus, usage of such phrases may refer to more than just one embodiment or aspect. In addition, the described features, structures, or characteristics may be combined in any suitable manner in one or more embodiments or aspects. Furthermore, reference to a single item may mean a single item or a plurality of items, just as reference to a plurality of items may mean a single item. Throughout this specification a washing machine or a dryer may be used as an example appliance. It is contemplated that embodiments of the invention may be used with other appliances such as a dishwasher, refrigerator, trash compactor, ice machine, etc.

Embodiments of the present invention utilize at least one container located within a pedestal situated beneath an appliance (e.g. washing machine, dryer, dishwasher, etc.) to house components to deliver an additive to the appliance. Upon receiving an input from a controller, a pump located within the pedestal may pump the additive from the container into the appliance (e.g. the tub of the washing machine). The at least one container located within the pedestal may be an integrated part of the appliance when assemble together with the appliance or a portable pedestal being separable from the washing machine or other appliance.

Other aspects of the invention may include having valves to control the amount of additives being added to the appliance. The valves may also be used to allow a single pump to deliver multiple additives housed in different containers. In addition, various embodiment of the invention may include sensors to alert a user to leaks within the system, low levels of additives or other maintenance/service related issues.

DETAILED DESCRIPTION

Figure 1:
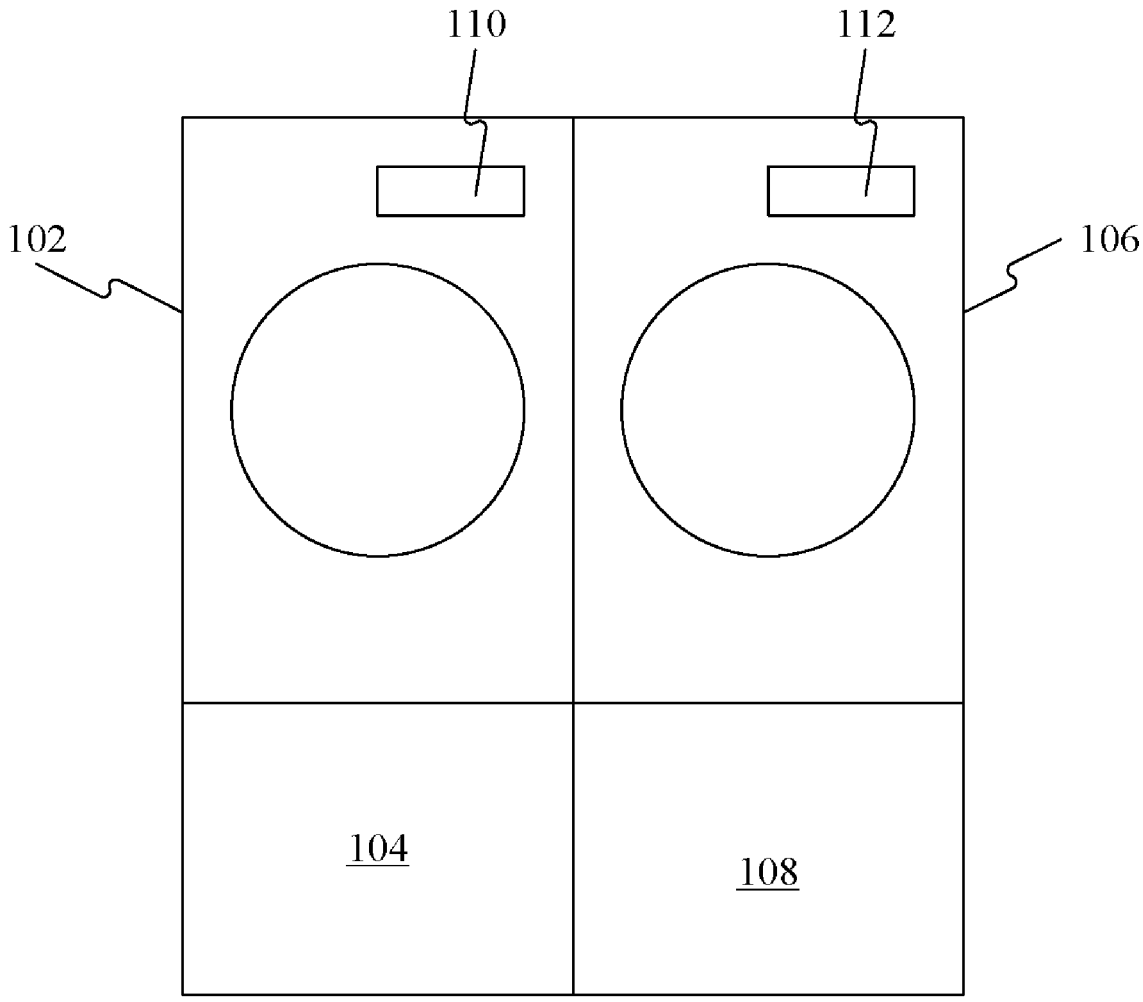
FIG. 1 depicts a washer and dryer combination sitting on pedestals.

Referring to FIG. 1, FIG. 1 depicts a washer and dryer combination sitting on pedestals. A washing machine 102 is located on top a washing machine pedestal 104. The washing machine 102 may also have a washing machine controller 110. The washing machine controller 110 may be used to control washing machine 102 operations as well as a system for delivering a washer additive to the washing machine 102. A dryer 106 may be located on top of a dryer pedestal 108. The dryer 106 may also have a dryer controller 112. The dryer controller 112 may be used to control dryer 106 operations as well as a system for delivering a dryer additive to the dryer 106. It is contemplated that the washing machine controller 110 and dryer controller 112 may communicate with each other and washing machine controller 110 may control the delivery of an additive to washing machine 102 and vise versa.

Figure 2:
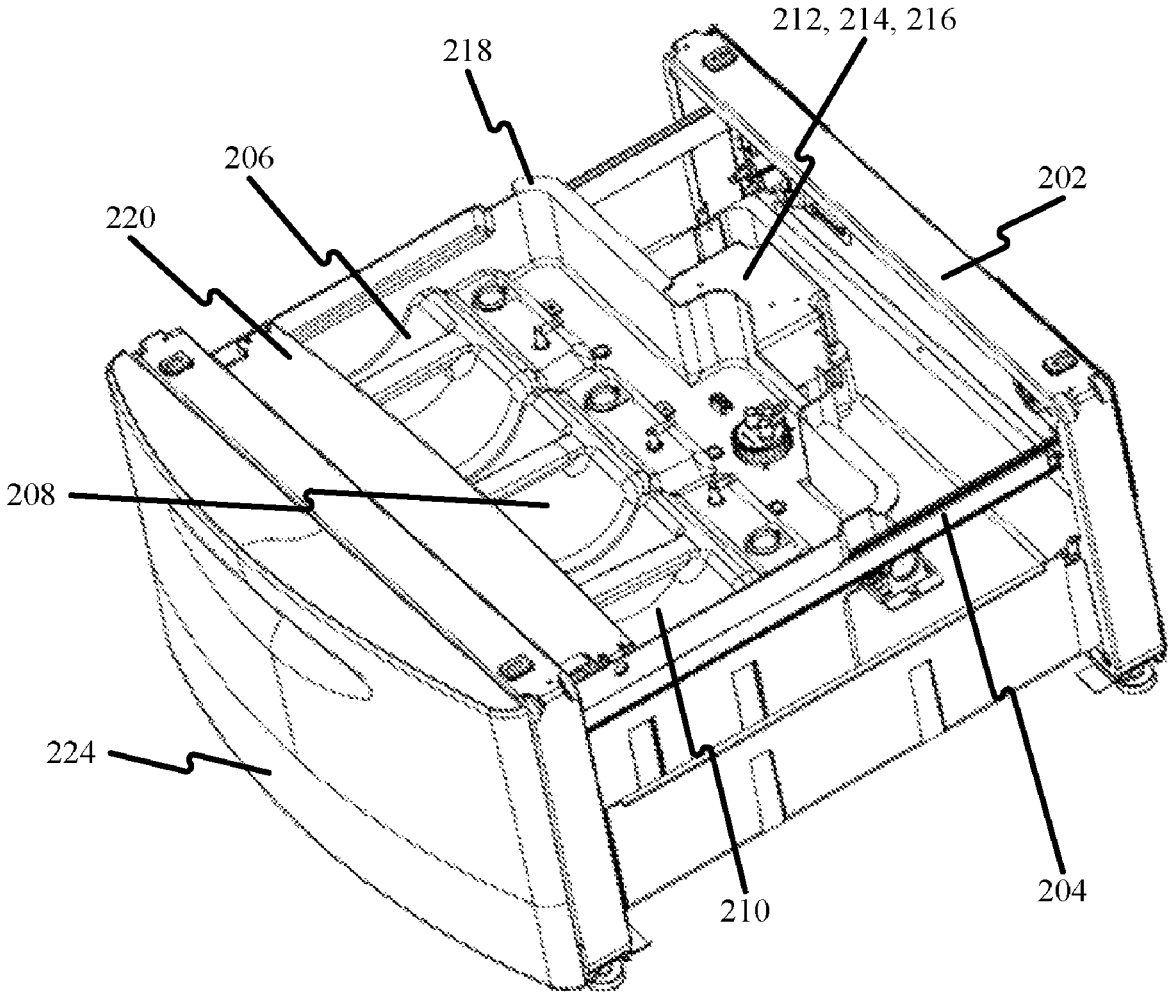
FIG. 2 depicts and additive deliver system located in a pedestal.

Referring now to FIG. 2, FIG. 2 depicts the washing machine pedestal 104. The washing machine pedestal 104 may include a housing 202 (cover plate has been removed for clarity). A drawer 204 may operatively slide in and out of the housing 202. Within the drawer 204 there may be containers 206, 208 and 210. Also contained within the drawer 204 there may also be a bracket 220 used to secure containers 206, 208 and 210 in place. The bracket 220 may also include a label that may indicate the contents of the containers 206, 208, and 210 located within the drawer 204. The drawer 204 may also contain a tray 218. The tray 218 may be used to house connections where piping connecting containers 206, 208 and 210 connect to peristaltic pumps 212, 214, and 216. The tray 218 may also contain tools and/or quick connect fasteners operatively configured to allow quick connecting of the containers 206, 208 and 210.

During operation of the washing machine 102 a user may select a predetermined mode. This predetermined mode may, for example, consist of washing whites, darks, delicates, full loads or fractional loads. When selecting this particular mode, the user may press a button on the washing machine controller 110. Upon pressing the button on the washing machine controller 110, peristaltic pump 212 may add detergent from the container 206. Additionally, the washing machine controller 110 may be programmed with various modes. For example, the washing machine controller 110 may be programmed such that during a first stage of a wash cycle a single additive from the container 206 may be added. During a second stage of the wash cycle, the washing machine controller 110 may add a second additive from the container 208. For example, during a first cycle, the clothes may be washed using laundry detergent. During the second stage of the wash cycle, a fabric softener may be added. Other examples may include, adding a rinsing agent, adding predetermined amounts of additives based on the laundry load size, etc. In addition, the washing machine controller 110 may be configured to facilitate a continuous delivery of an amount of additive to the washing machine while the user continuously depresses a button.

While FIG. 2 depicts three peristaltic pumps 212, 214 and 216, it is contemplated that a single peristaltic pump may be used in conjunction with a single container or multiple containers. In embodiments in which a single peristaltic pump is used for multiple containers, various valve assemblies may be necessary in order to inhibit the flow of a particular additive from a particular container. In addition, various piping manifolds may be necessary in order to connect the containers 206, 208, and 210 to a single peristaltic pump. For example, if a single peristaltic pump is connected to the containers 206, 208, and 210, a manifold utilizing valves (e.g. solenoid valves, etc.) may be needed to facilitate the delivery of an additive from container 206 to the washing machine 102 without delivering an additive from container 208 or 210. In addition, the manifold may be configured to deliver two or more additives via a single pump.

While FIG. 2 depicts the containers 206, 208 and 210 being of equal size, it is contemplated that the containers 206, 208 and 210 may varying in size. For example, the container 206 may be a half-gallon container containing fabric softener, whereas the container 208 may be a one-gallon container housing laundry detergent.

In addition, the containers 206, 208 and 210 may be disposable. The containers 206, 208 and 210 may also be refillable (i.e., new additives may be added without removing the containers 206, 208 and 210 from the drawer 204). It is contemplated however, that the containers 206, 208 and 210 may be removable, refillable, disposable, and washable. For example, the container 210 may be removed periodically by the user and washed. After a certain time or if the container 210 becomes damaged, the container 210 may be replaced.

Additionally, the containers 206, 208 and 210 may include float sensors or other means to determine additive levels within the containers 206, 208 and 210. This information may be fed to the washing machine controller 110 to provide an indication to the user that the additive is running low and needs to be refilled. Additionally, the drawer 204 may contain an indicator to indicate the presence of additive within the drawer 204. For example, if there is a leak in the container 208, a contact sensor or other detection means may send a signal to washer controller to notify the user.

Furthermore, the containers may include specialized connections such that only a certain container may be connected to a certain pump. In various aspects of the invention, the container 206 may include a specialized connection such that only a container of similar type to the container 206 may be connected to the peristaltic pump 212. For example, the washing machine controller 110 may be programmed such that the peristaltic pump 212 delivers fabric softener. The container 206 may be labeled fabric softener (e.g. color coded or a label) or may be a disposable fabric softener container. The specialized connection would then help the user from inadvertently connecting a container of soap to a connection designed for fabric softener.

During operation the peristaltic pumps 212, 214 and 216 remove additives from the containers 206, 208 and 210 via siphoning the additives from the containers 206, 208 and 210. In other words, peristaltic pumps 212, 214 and 216 remove additives from the containers 206, 208 and 210 without causing a substantial pressure change within the containers 206, 208 and 210. A substantial pressure change may be a pressure change that would result in fluid flow. In other words, the pressure inside the containers 206, 208 and 210 will not increase or decrease to a point that would cause fluid to flow. For example, as described in the background section, current additive delivery systems pump air into a container to increase pressure within the container. The increase in pressure causes the additive to flow. In embodiments of the current invention, additives flow because of the head applied by the pump directly to the fluid.

While the peristaltic pumps 212, 214 and 216 are described as peristaltic pumps, it is contemplated that other types of pumps may be used such as positive displacement pumps, rotary vein pumps, etc. without departing from the scope of the invention. Peristaltic pumps allow for delivery of the additive without the additive coming into contact with the pump. This reduces the risk of the additives becoming contaminated with pump lubricants, or harsh additives which may cause excessive wear on the pumps, etc.

While the drawer 204 has been described as a "sliding drawer," it is contemplated that the drawer 204 may be stationary and a pedestal face 224 may be operatively hinged. For example, the pedestal face 224 may be hinged to allow access to the containers 206, 208, and 210. In this example, containers 206, 208, and 210 may slide out of the drawer 204.

Additionally, the pumps may be connected to the containers 206, 208, and 210 via flexible or rigid piping. For example, for use in a washing machine, plastic tubing may be used for the piping system. For harsher environments such as a parts washer in an automotive garage, rigid tubing may be needed for the piping system.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

I claim:

1. A washing machine having a body and an interior section of the body, the washing machine comprising:

a pedestal located beneath the body and supporting the washing machine, the pedestal comprising a drawer operative to slide into and out of the pedestal;

a first storage container having a first float switch and a second storage container having a second float switch, the first storage container and the second storage container each located in the drawer, the first float switch and the second float switch each operatively connected to a controller, the controller being configured to provide an indication when either a first content of the first storage container or a second content of the second storage container is below a preset level;

a peristaltic pump located in the pedestal and operatively connected to the controller;

a manifold located in the pedestal and in fluid communication with the peristaltic pump, the first storage container, and the second storage container, the manifold having at least one valve operative to allow the peristaltic pump to pump the first content from the first storage container without delivering the second content from the second storage container, the peristaltic pump being operative to pump the first content from the first storage container includes the peristaltic pump being operative to pump the first content from the first storage container by application of a head by the peristaltic pump directly to the first content of the first storage container without causing an increase in a pressure inside the first storage container that would result in a flow of the first content from the first storage container, the first content of the first storage container comprising a fluid, the fluid comprising at least one cleaning additive;

a leak sensor operative to detect when either the first storage container or the second storage container contain has a leak, the leak sensor located in the drawer and operatively connected to the controller, the controller being configured to provide a leak indication upon receiving a signal from the leak sensor;

a piping system operatively connecting the first storage container, the second storage container, and the manifold to the peristaltic pump and the interior section.

2. The washing machine of claim 1, wherein the first storage container has a first specialized connection such that only a first replacement storage container similar to the first storage container will connect to the piping system where the first storage container connects to the piping system; and the second storage container has a second specialized connection such that only a second replacement storage container similar to the second storage container will connect to the piping system where the second storage container connects to the piping system.

* * * * *